US006394577B1

(12) United States Patent
Wen et al.

(10) Patent No.: US 6,394,577 B1
(45) **Date of Patent: *May 28, 2002**

(54) INK JET PRINTING ON A RECEIVER ATTACHED TO A DRUM

(75) Inventors: Xin Wen, Rochester; David L. Jeanmaire, Brockport, both of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/377,482

(22) Filed: Aug. 19, 1999

(51) Int. Cl.[7] ..... B41J 2/21
(52) U.S. Cl. ..... 347/43; 347/37
(58) Field of Search ..... 347/37, 38, 39, 347/12, 40, 41, 43, 234, 235, 248, 250; 346/139 D

(56) References Cited

U.S. PATENT DOCUMENTS

| | | | | | |
|---|---|---|---|---|---|
| 4,069,485 | A | * | 1/1978 | Martin | 347/12 |
| 4,112,469 | A | | 9/1978 | Paranjpe et al. | 358/296 |
| 4,131,899 | A | | 12/1978 | Christou | 347/71 |
| 4,490,728 | A | | 12/1984 | Vaught et al. | 347/60 |
| 4,723,129 | A | | 2/1988 | Endo et al. | 347/56 |
| 4,855,752 | A | * | 8/1989 | Bergstedt | 347/41 |
| 4,878,063 | A | * | 10/1989 | Katerberg | 347/19 |
| 4,999,646 | A | * | 3/1991 | Trask | 347/41 |
| 5,889,534 | A | | 3/1999 | Johnson et al. | 347/19 |
| 6,249,306 | B1 | * | 6/2001 | Isono et al. | 347/233 |

FOREIGN PATENT DOCUMENTS

| | | |
|---|---|---|
| EP | 0 827 833 A2 | 3/1998 |
| WO | WO 98/08687 | 3/1998 |

* cited by examiner

*Primary Examiner*—John Barlow
*Assistant Examiner*—Blaise Mouttet
(74) *Attorney, Agent, or Firm*—Raymond L. Owens

(57) ABSTRACT

Ink jet printing apparatus in response to a digital image for forming an ink image on a receiver attached to the surface of a drum rotatable about an axis. The ink jet printing apparatus includes an actuable ink jet print head movable in a direction parallel to the drum axis for delivering ink to the receiver, and rotates the drum such that the attached receiver moves at a predetermined surface velocity. The ink jet printing apparatus moves the ink jet print head at a velocity less than the predetermined velocity of the receiver so that the print head scans an area of drum surface that is skewed relative to the drum axis, and circuitry response to the digital image for simultaneously controlling the rotating and the moving means and means for actuating the inkjet print head to form an ink image within the scanned area wherein two edges of the ink image are parallel to the drum axis and two edges of the ink image are perpendicular to the drum axis.

6 Claims, 2 Drawing Sheets

INK JET PRINTING ON A RECEIVER ATTACHED TO A DRUM

FIELD OF THE INVENTION

The present invention relates to ink jet printing on a receiver that is rotated by a drum.

BACKGROUND OF THE INVENTION

Ink jet printing has become a prominent contender in the digital output arena because of its non-impact, low-noise characteristics, and its compatibility with plain paper. Inkjet printers avoid the complications of toner transfers and fixing as in electrophotography, and the pressure contact at the printing interface as in thermal resistive printing technologies. Ink jet printing mechanisms includes continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Piezoelectric ink jet printers can also utilize piezoelectric crystals in push mode, shear mode, and squeeze mode. EP 827 833 A2 and WO 98/08687 disclose a piezoelectric ink jet print head apparatus with reduced crosstalk between channels, improved ink protection, and capability of ejecting variable ink drop size.

U.S. Pat. No. 4,723,129, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which causes an ink drop to be ejected from small apertures along the edge of the heater substrate. This technology is known as Bubblejet™ (trademark of Canon K. K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

Drum based receiver transport mechanism has the advantages of small foot print and the capabilities of unidirectional printing with high printing duty cycles. The printing of an image can be made by an index mode in which the print head translates to a position and stays there while printing a swath of image while the drum rotates along the fast-scan direction. After the swath is finished, the print head is translated again to the next printing position, the next swath is printed. This printing method requires the print head to move between printing swaths, which is a non-printing overhead to the operation and thus lowers throughput.

The ink image can also be printed on the drum surface by simultaneously translating the print head and rotating the drum. The ink nozzles produce spiral or helical paths on the ink receiver attached to the drum surface. One difficulty of this technique is that the helical paths produce a skew between the columns and rows of ink dots, as described in U.S. Pat. Nos. 4,112,469 and 4,131,898. The skew increases with the print head width. The skew becomes very severe for wide print heads (1", 2" to page wide).

U.S. Pat. No. 5,889,534 discloses calibration and registration method for manufacturing a drum based printing system. The receiver is skewed to produce a square image comer. This technique, however, requires the receiver to be precisely skewed relative to the drum axis, which is often difficult. In addition, the timing of the ink drop ejection needs to be precisely varied between nozzles to provide tilted rows of ink dots (FIG. 19).

SUMMARY OF THE INVENTION

An object of the present invention is to provide quality ink images on a receiver attached to a rotating drum.

This object is achieved by ink jet printing apparatus in response to a digital image for forming an ink image on a receiver attached to the surface of a drum rotatable about an axis, comprising:

a) an actuable ink jet print head movable in a direction parallel to he drum axis for delivering ink to the receiver;

b) means for rotating the drum such that the attached receiver moves at a predetermined surface velocity;

c) means for moving the ink jet print head at a velocity less than the predetermined velocity of the receiver so that the print head scans an area of drum surface that is skewed relative to the drum axis; and d) control means responsive to the digital image for simultaneously controlling the rotating and the moving means and means for actuating the ink jet print head to form an ink image within the scanned area wherein two edges of the ink image are parallel to the drum axis and two edges of the ink image are perpendicular to the drum axis.

A feature of the present invention is to provide images with two edges being perpendicular the drum axis and two edges being parallel to the drum axis.

One advantage of the present invention is that the ink receiver can be easily aligned on the drum surface.

Another advantage of the present invention is that the ink nozzles in an ink jet print head can be aligned along the drum axis to permit simultaneous ejection of ink drops from different ink nozzles.

DETAILED DESCRIPTION OF THE INVENTION

Figure 1:
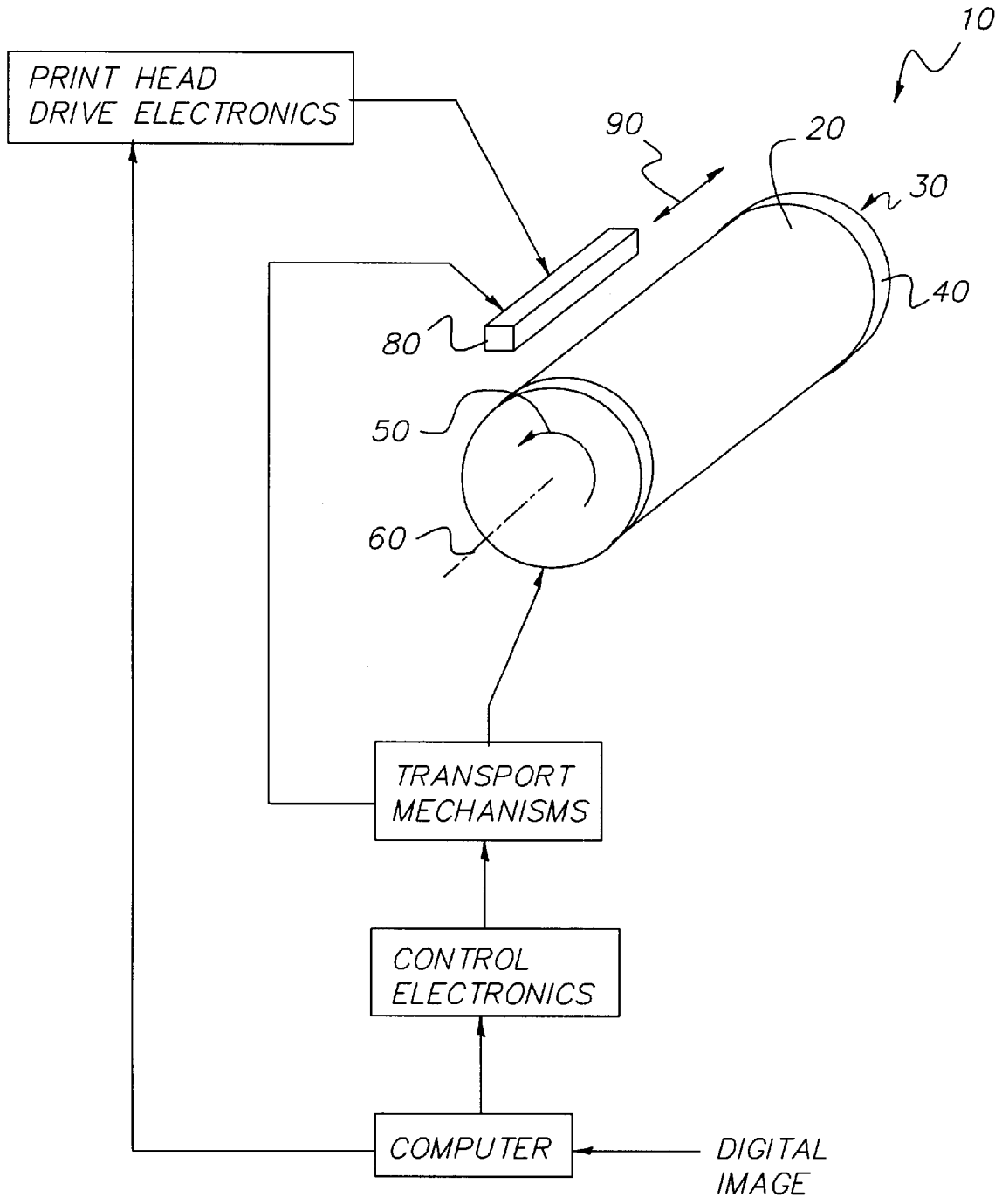
FIG. 1 shows a partial schematic of the drum based ink jet printing system in accordance with the present invention.

FIG. 1 shows a drum-based ink jet printing apparatus 10 in accordance with the present invention. A receiver 20 is fixed around the surface of a rotatable drum 30. The rotation of the drum 30 can be implemented for example by a transport system including a brushless DC motor, and a gearbox coupled to the drum shaft. The receiver 20 can be held to the drum surface 40 by a vacuum sucking force or electrostatic force to the drum surface 40. A typical range for the drum diameter is from 4 inches to 40 inches. The axial length of the drum 30 can vary from 10 inches to 80 inches for printing receivers of different widths. The drum 30 can be rotated about a drum axis 60 to move the receiver 10 around a fast scan direction 50.

Figure 2:
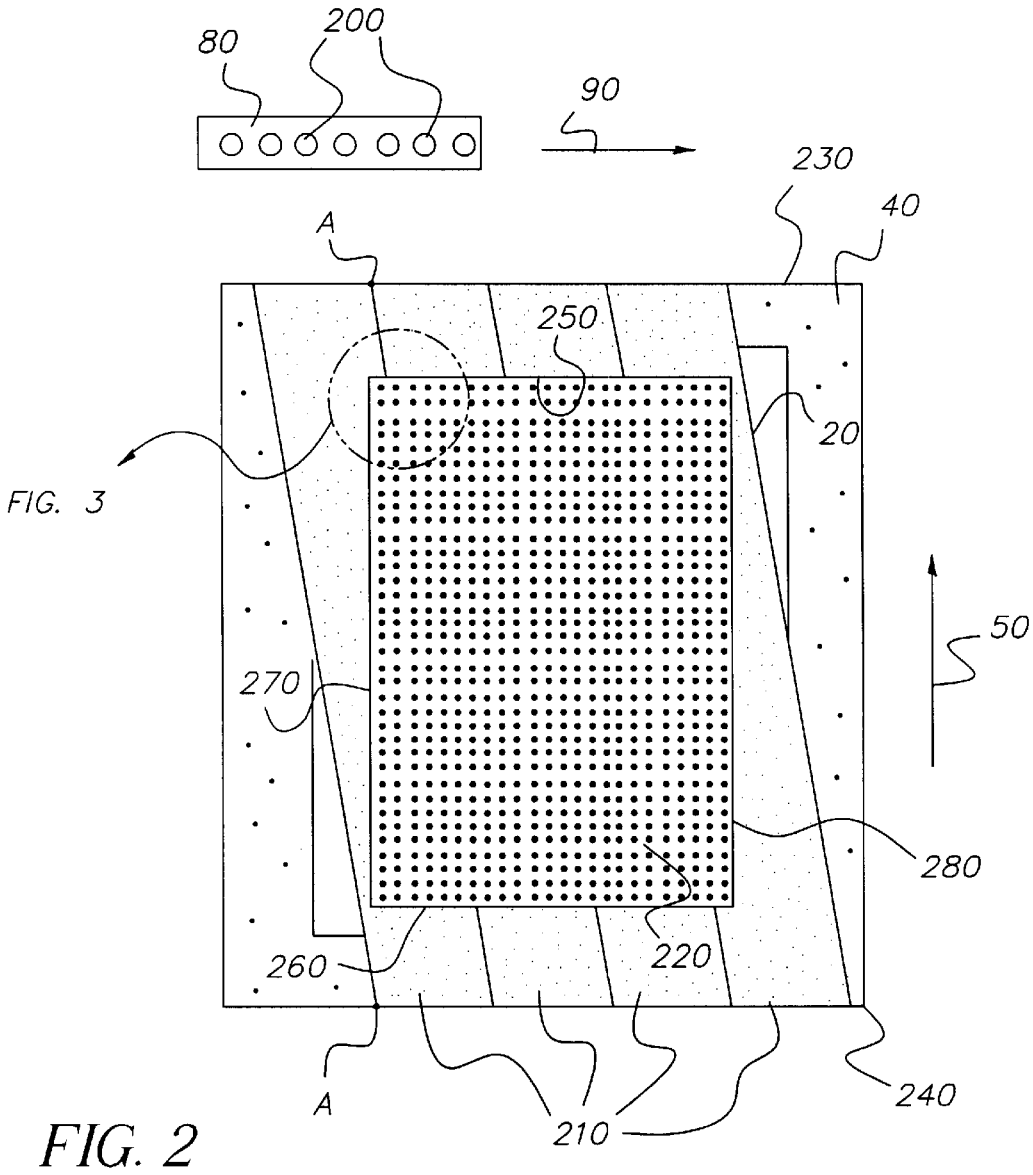
FIG. 2 shows the relative arrangements of the image area, scan swaths, and the receiver on the drum surface.

A print head 80 is positioned adjacent to but spaced apart from the receiver 20 for delivering ink drops to the receiver 20 for forming ink images. The print head 80 includes a plurality of ink nozzles 200 (FIG. 2) and is arranged along a slow scan direction 90. The slow scan direction 90 is parallel to the axis of the drum 30. For example, the print head 80 may include 1 to 2400 nozzles. The ink nozzles can be aligned in one or more linear arrays, as shown in FIG. 2. The distance between neighboring nozzles 200 in the slow scan direction 90 can vary from $1200^{th}$ to $150^{th}$ of an inch. The print head 80 can be a thermal, piezoelectric, or continuous ink jet print head. For printing color ink images, different colored inks can be used. Ink colors can include yellow, magenta, cyan, black, red, green, blue, orange, gold and silver, with each ink has its own ink supply and ink nozzles for delivering the inks. For each color, inks of different colorant concentrations can be used. One advantage of having the print heads moving in the slow scan direction 90 rather than the fast scan direction 50 is that the electronic interconnections and the ink supply lines are less likely to hinder the motion at the lower velocity in the slow scan direction 90. This is especially beneficial when a plurality of ink jet print heads are involved. In addition, the slow motion also produces smaller pressure perturbation to the ink fluid in the ink chambers inside the print head 80, thus reducing the sloshing motion of the ink in the print head. It is well known in the art that the ink pressure variations in the print head can negatively impact the repeatability and the reliability of the ink drop ejections from ink jet print head.

A computer 100 receives or generates a digital image. The computer 100 stores and processes the digital image and sends electric signals corresponding to the processed image to print head drive electronics 110. The print head drive electronics 110 prepares electric signals appropriate for actuating the ink drops at each pixel on the receiver 20 so that the digital image can be reproduced on the receiver 20. The rotational motion of the drum 30 and the translational movement of the print head 80 are both controlled by control electronics 120 which is in turn controlled by the computer. Servo control transport mechanisms 130 can be used to control the rotation of the drum 30 and the movement of the print head 80.

In FIG. 2, the curved drum surface 40 is flattened for illustrating the relative arrangement of the drum surface 40, the receiver 20, the scan swaths 210, and the image area 220. The print head 80 includes a plurality of ink nozzles 200 in one or a multiple of linear arrays. The nozzles are aligned in parallel to the slow scan direction 90. The upper edge of the drum surface 40 is the same edge as the lower edge of the drum surface 40.

During printing, the computer 100 and the control electronics 120 simultaneously move the print head 80 along the slow scan direction 90 and moves the receiver 20 along the fast scan direction 50. Preferably, the print head 80 and the receiver 20 both move uniformly along respective directions during printing. These simultaneous motions produce helical (or spiral) paths for print head 80 over the drum surface 40. In the planar view in FIG. 2, the continuous helical path is broken down to a plurality of scan swaths 210. As the upper edge 230 and the lower edge 240 of the drum surface 40 are identical, the two points "A" in FIG. 2 are also the same point that is split when the curved drum surface is flattened to produce the planar view. In other words, the lower edge of a scan swath becomes the upper edge of the next scan swath. The width of each scan swath is the same or narrower than the width of the print head 80.

The print head 80 ejects ink drops in an image area 220 on the receiver 20 while the print head 80 moves along the slow scan direction 90 and the receiver 20 moves along the fast scan direction 50. In accordance with the present invention, the computer 100 processes the digital image and the control electronics 120 controls the timing of the ink drop ejections so that an ink image is formed within a rectangular image area 220, even if the scan swaths are skewed relative the drum axis 60 and the print head 80. The upper image edge 250 and the lower image edge 260 are parallel to the drum axis 60. The left image edge 270 and the right image edge 280 are perpendicular to the drum axis 60. In accordance with the present invention, the receiver 20 is also rectangular shaped. The top and bottom edges of the receiver 20 are also parallel to the drum axis 60. The four edges (250–280) of the image area 220 are therefore aligned parallel with the respective edges of the receiver 20.

Figure 3:
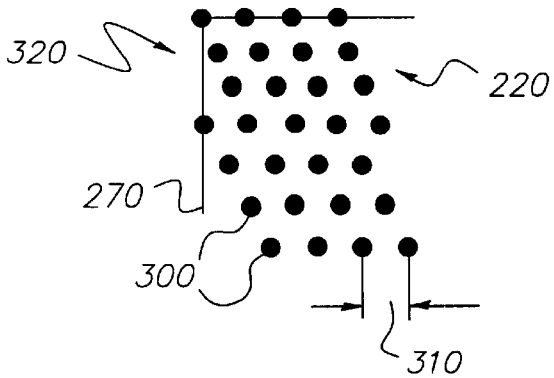
FIG. 3 shows details of the ink dot pattern near a comer of the image area.

A detailed view of the ink dots 300 around the upper left comer of the image are 220 is shown in FIG. 3. The same structure will be found in the other comers of the image area 220. In FIG. 3, the upper image edge 250 comprises a straight row of ink dots 300 that are parallel to the drum axis 60. This row of ink dots 300 is formed on the receiver 20 by simultaneously ejecting ink drops from each array of ink nozzles 200 that are distributed parallel to the drum axis 60. The ink dots 300 in the image area 220 can be viewed in rows and columns. The ink dots 300 also define a pixel width 310 for each image pixel of the image. Due to the helical scanning path of the print head 80 relative to the drum surface 40, the columns of the ink dots 300 are skewed relative to the rows of the ink dots 300. The left image edge 270 (or right image edge 280) thus include ink dots 300 with different degree of horizontal offsets; the horizontal offsets from the skewed image columns are smaller that one pixel width 310. That is, when the horizontal offset becomes one pixel width 310, a new column of ink dots 300 starts along the left image edge 270. Although the left and right image edges 270 and 280 include microscopic jogs 320, they are not visible to eyes at high enough printing resolution. For example, 600 or 1200 dots per inch can be printed in compatible with present invention. It should be noted that the degree of skew is significantly exaggerated to illustrate the invention. For a drum circumference of 40 inches and a scan swath width of 0.5 inch, there is only one jog 320 in every 80 rows of ink dots 300. The jogs 320 along the left and right image edges 270 and 280 can be formed at different or the same vertical positions in different color planes. In a 4-color ink jet printing, still using the above example, the jogs 320 between the yellow, magenta, cyan and black planes can be offset by 20 rows of ink dots 300. The spatial frequency of the jogs 320 along the left and right image edges 270 and 280 are therefore optimized to minimize their visual effect.

The invention has been described in detail with particular reference to certain preferred embodiments thereof, but it will be understood that variations and modifications can be effected within the spirit and scope of the invention.

PARTS LIST

10 ink jet printing apparatus
20 receiver
30 drum
40 drum surface
50 fast scan direction
60 drum axis
80 print head
90 slow scan direction
200 ink nozzle
210 scan swath

220 image area
230 upper edge
240 lower edge
250 lower image edge
260 lower image edge
270 left image edge
280 right image edge
300 ink dots
310 pixel width
320 jog

What is claimed is:

1. Ink jet printing apparatus in response to a digital image for forming a color ink image on a receiver attached to the surface of a drum rotatable about an axis, comprising:

a) actuable ink jet print head means movable in a direction parallel to the drum axis for selectively delivering a plurality of colored inks to the receiver;

b) means for rotating the drum such that the attached receiver moves at a predetermined surface velocity;

c) means for moving the ink jet print head at a velocity less than the predetermined velocity of the receiver so that the print head scans an area of drum surface that is skewed relative to the drum axis; and d) control means responsive to the digital image for simultaneously controlling the rotating and the moving means and means for actuating the ink jet print head means to form a rectangular colored ink image area, which is composed of a plurality of color planes that correspond respectively to the colored inks, within the scanned area;

wherein a first edge and a second edge of the colored ink image area are respectively formed by a top row and a bottom row of ink dots which are parallel to the drum axis and a third edge and a fourth edge of the colored ink image area are perpendicular to the drum axis;

wherein in each respective color plane a plurality of jogs in the third and fourth edges are respectively formed by a leftmost and a rightmost column of ink dots respectively having increasing degrees of horizontal offset from the third and fourth edges;

wherein the horizontal offset is less than or equal to one pixel width and a new column of ink dots is started along the third and fourth edges when the horizontal offset has increased to equal one pixel width; and wherein the jogs which correspond to one color plane are formed at different vertical positions from the jogs which correspond to the other color planes.

2. The ink jet printing apparatus of claim 1 wherein when actuated the ink jet print head means produce color ink dots columns skewed relative to the axis of the drum.

3. The ink jet printing apparatus of claim 1 wherein the color ink dots are distributed in helical or spiral paths.

4. The ink jet printing apparatus of claim 1 wherein the edges of the color ink image perpendicular to the drum axis include dots on the edges and dots offset from the edges so that human eye will perceive straight edges that are perpendicular to the drum axis.

5. The ink jet printing apparatus of claim 1, wherein the jogs for one of the color planes are offset from an other one of the other color planes by a predetermined number of rows of ink dots.

6. The ink jet printing apparatus of claim 5, wherein the offset is optimized to minimize their visual effect.

* * * * *